United States Patent [19]

Keener

[11] 4,084,073

[45] Apr. 11, 1978

[54] FLOAT-TYPE PUMP CONTROL SWITCH

[76] Inventor: Robert M. Keener, 890TR875, Rte. #3, Ashland, Ohio 44805

[21] Appl. No.: 760,628

[22] Filed: Jan. 19, 1977

[51] Int. Cl.[2] ..... H01H 35/18; F04B 49/04

[52] U.S. Cl. ..... 200/84 R; 340/244 B; 417/40

[58] Field of Search ..... 417/40; 200/84 R; 340/244 B; 73/308, 313

[56] References Cited

U.S. PATENT DOCUMENTS

| | | | |
|---|---|---|---|
| 2,885,507 | 5/1959 | Holman | 340/244 B X |
| 3,090,849 | 5/1963 | Coulin | 200/84 R |
| 3,866,470 | 2/1975 | Miller | 73/313 |
| 4,021,144 | 5/1977 | Matsusake | 417/40 |

FOREIGN PATENT DOCUMENTS

| | | | |
|---|---|---|---|
| 1,235,610 | 3/1967 | Germany | 73/313 |

*Primary Examiner*—Carlton R. Croyle
*Assistant Examiner*—R. E. Gluck
*Attorney, Agent, or Firm*—Oldham, Oldham, Hudak & Weber Co.

[57] ABSTRACT

The float switch is for control of a submersible sump pump or the like and has a housing, a switch in the housing and with the switch having a spring control member extending therefrom to turn the switch on and off with movement of such control member, leads connecting to the switch and extending from the housing to the power controlled circuit. An activator arm is pivotally positioned in the housing for gravity actuated pivotal movement towards and away from the switch for engaging and moving the control member to switch closed position and to release it for switch opening action, the position of the activator arm being controlled by gravity and the float switch being permitted only limited movement with fluctuations in the water level in the sump by the leads secured thereto.

5 Claims, 6 Drawing Figures

FIG - 1
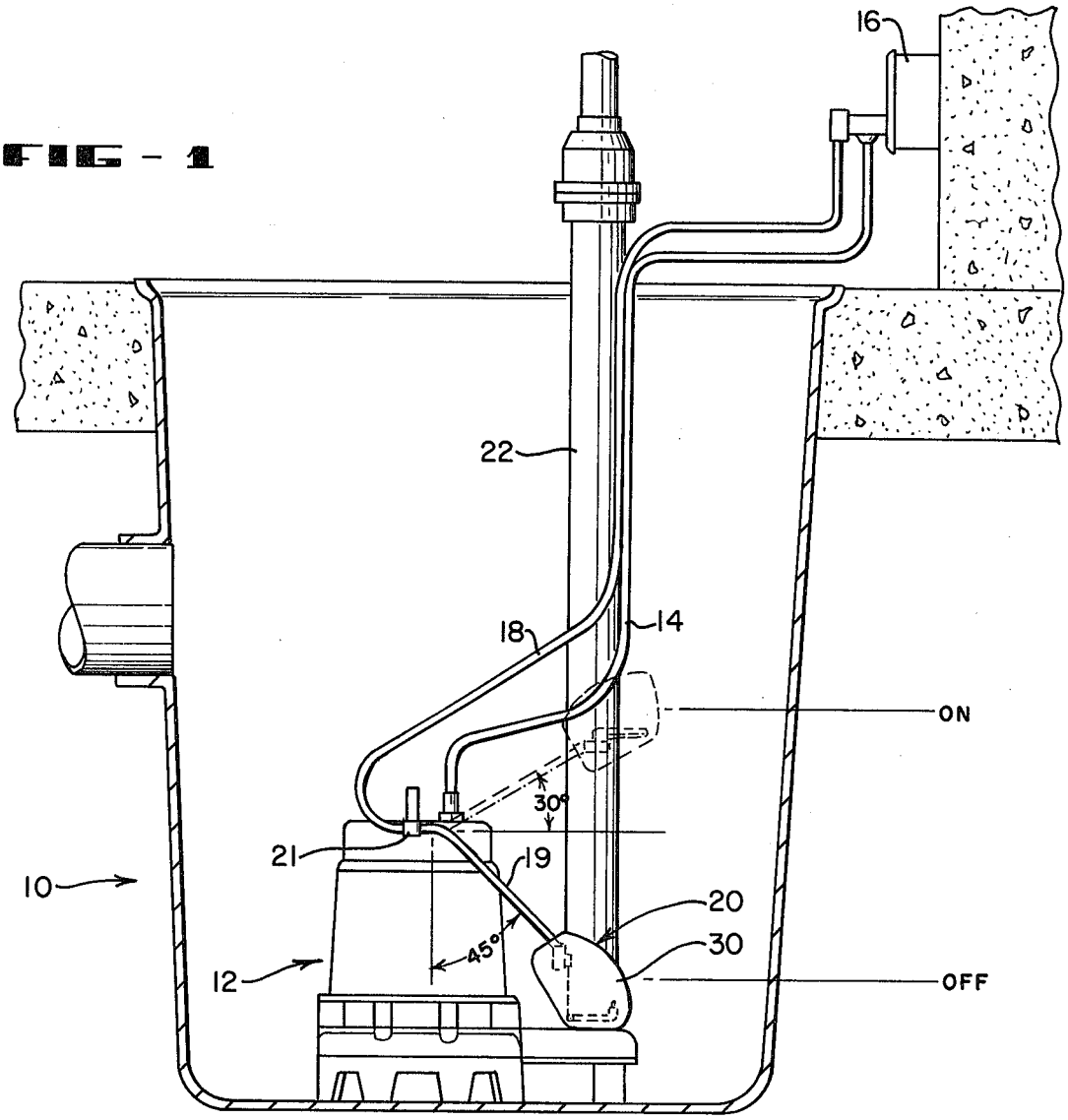
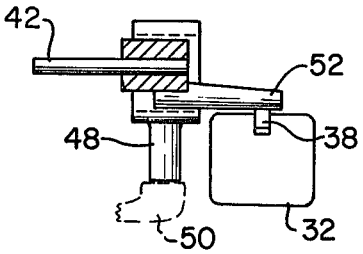
FIG - 4
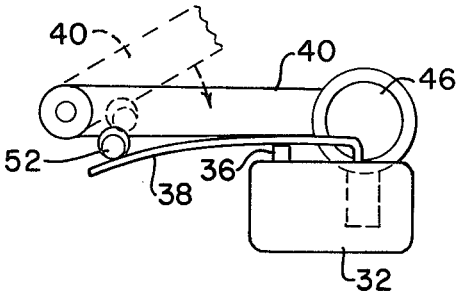
FIG - 5

FLOAT-TYPE PUMP CONTROL SWITCH

BACKGROUND OF INVENTION

Heretofore there have been many different types of float switches provided and a number of such float-type switches have been particularly designed for use in controlling the water level in a sump. Thus, most sumps have a submersible sump pump provided therein and some type of a float switch control is used in many of such sumps for pump operation control whereby the pump is controlled automatically to have the pump turned on when the water level goes above a predetermined level in the sump and the switch automatically shuts off as the water level in the sump is reduced to a predetermined depth. Patents issued on controls of this type include U.S. Pat. No. 4,001,533 but other float control switches have been widely sold commercially.

These float control switches should be quite dependable, and naturally it is desired that an efficient switch be provided at a relatively inexpensive cost. The switches should operate without being restrained to movement solely in a vertical plane.

It is the general object of the present invention to provide an improved float-type control switch particularly designed for use with sumps to control the water level therein, which switch is characterized by the provision of an activator arm pivotally positioned with the switch housing and having releasable pressure contact with a switch control member dependent upon the arcuate position of the float-type control switch as supported on the water in the sump in relation to a fixed member adjacent the switch.

Another object of the invention is to provide a sturdy type of a float control switch including a plastic housing, a switch positioned within the housing and having a control finger extending therefrom, and a control arm pivotally positioned in the switch housing for movement to engage the switch and the control finger thereof as the vertical arcuate position of the switch changes; the switch normally having leads connected thereto and extending a short distance therefrom for attachment to a clamp or base and provide limited arcuate movement of the switch and lead assembly as it floats on the water pool in a sump.

Another object is to provide a dependable, maintenance free control switch for a sump.

Yet another object of the invention is to provide a substantially all plastic switch assembly which has a metal weight positioned on an actuator arm in the assembly to provide a greater switch closing force in the switch assembly when required.

Other objects and advantages of the invention will be made more apparent as the specification proceeds.

Reference now is particularly made to the accompanying drawings, wherein:

FIG. 1 is an overall elevational view, partly diagrammatic, of a switch and its operative assembly in a sump;

FIG. 4 is a detail section taken on line 4—4 of FIG. 2B; and

FIG. 5 is a detail side elevation of the activator arm and associated means.

When referring to corresponding members shown in the drawings and referred to in the specification, corresponding numerals are used to facilitate comparison therebetween.

SUBJECT MATTER OF INVENTION

Figure 2A:
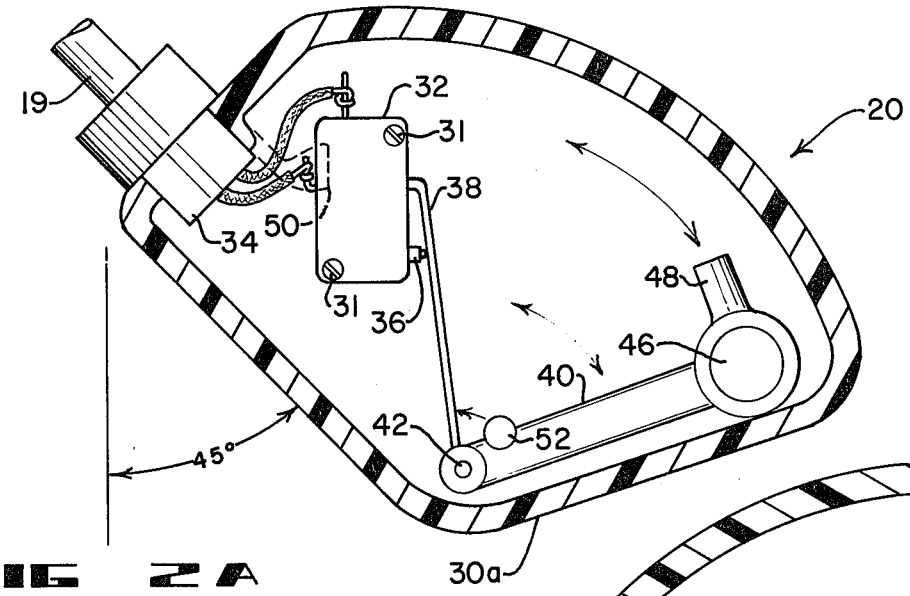
FIGS. 2A and 2B are enlarged fragmentary elevations of the switch of the invention, when open, and closed.

The present invention relates to the combination of a sump pump, a sump, and a float-type control switch operatively connected to the sump pump and its motor, and wherein the float switch includes a housing, a switch in the housing and having a spring control arm extending from the switch housing for automatically opening the switch as released and for closing the switch when forced to move towards the switch body; an activator arm pivotally positioned in the housing for pivotal movement and moved by gravity towards and away from the switch and the spring control arm thereof to move the spring control arm to a switch closing position or to release the same dependent upon the angular relationship of the switch and its housing to a fixed member in the sump, which relationship is determined by floating the switch on a body of water in a sump and changing such relationship by variation of the water level in the sump.

Attention now is directed to the construction shown in the drawings, and a sump 10 is indicated that has a sump pump 12 positioned therein. This pump 12 includes an electric drive motor as a portion of the pump assembly and such pump has power supply leads of any conventional type connecting thereto, such as the lead 14 extending from a control panel 16 that is positioned above ground. In this particular unit, another lead 18 extends from the control panel 16 down to the motor assembly and protrudes from such pump assembly 12 to connect to a control switch or means 20. The lead 18 has an end section thereon 19 that extends from the pump assembly 12 as the lead 18 is suitably secured to such pump assembly or other stationary article in a fixed manner by any conventional means, such as a clamp 21 whereby only a relatively short lead 19 is provided for control of movement of this control switch 20 in relation to the sump pump assembly as the switch floats on the liquids in the sump.

FIG. 1 of the drawing clearly indicates an "on" line and an "off" line where, as the control switch 20 floats on the water in the sump 10, the switch will rise with the water up to the "on" line, at which time the switch 20 is automatically closed to supply power to the pump 12 as hereinafter described. Then, as the pump lowers the level of fluids in the sump 10 by pumping fluids from the sump through the outlet tube 22, ultimately the fluid level is reduced to the "off" level indicated at which time the control switch 20 is adapted to open automatically and shut off the sump pump 12.

Figure 2B:
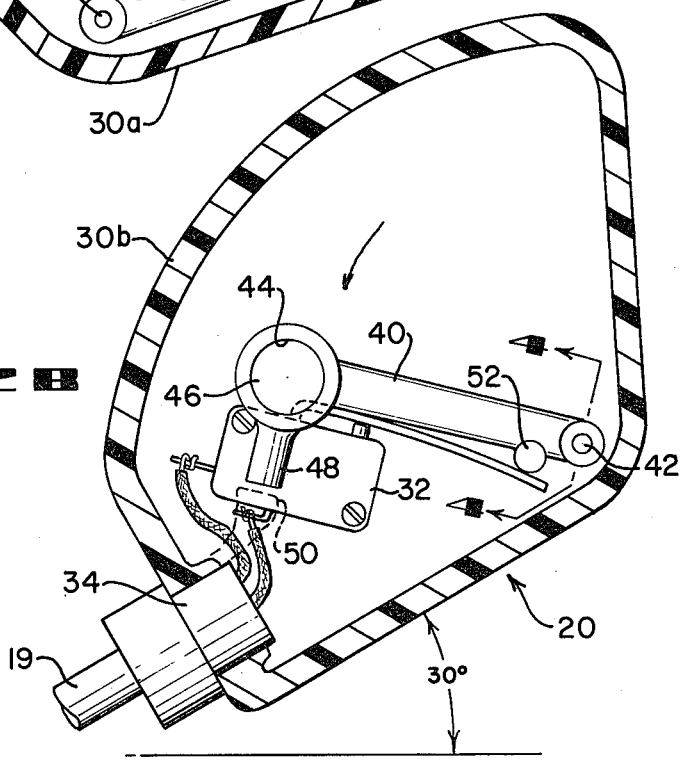
Figure 3:
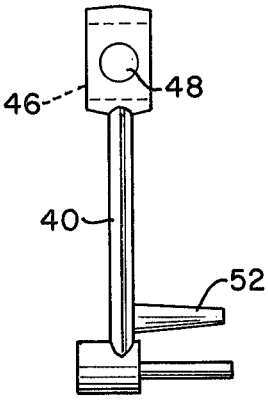
FIG. 3 is a detail elevation of the activator arm of the switch.

FIGS. 2A and 2B show further details of the control switch of the invention and this switch 20 includes a housing 30, normally formed in two sections split substantially vertically of the control switch to form housing sections **30*a* and 30*b*. These housing sections are formed from any suitable material such as a lightweight, sturdy plastic, such as polyurethane or flame retardant ABS and a known type of a switch 32 is suitably secured in the housing 30 as by screws 31 engaging the housing section 30*a* to take the position shown in FIG. 2. The lead section 19 extends into the housing 30 through any suitable type of a sealed joint or sleeve 34. The switch 32 has a resiliently positioned control means or pin 36 extending therefrom which, when moved inwardly of the switch, can change the operative connections therein, and the switch 32 has a control bar or strip 38 operatively secured thereto and extending therefrom immediately adjacent the exposed end of the control pin 36. The pin 36 normally is biased outwardly of the switch. Hence, as the free end of the bar 38 is moved toward the switch 20, then the finger or bar moves the pin 36 inwardly of the control switch and changes the electrical connection therein, normally, to close such control switch 20. Such closure action is provided by an activator arm 40 that is pivotally positioned within the housing 30 by a support rod or pin 42 on the arm engaging a boss formed as part of the housing. This are has an annular opening 44 formed at its free end, which opening normally receives a metal plug 46 therein. Such metal plug 46 is heavy enough to aid in gravity activated movement of the activating arm dependent upon the arcuate position of the control switch in relation to the sump pump. The metal plug may, for instance, weigh about an ounce to an ounce and one-half. the activator arm itself is made of plastic and has a finger 48 extending therefrom which is adapted to seat upon a stop shoulder 50 provided in one of the housing sections, and this limits movement of the free end of the actuator arm toward the control switch 32. Also the pivotal movement of the activator arm is transmitted to the control bar 38 by an offset pin 52 formed as an integral portion of the activator arm, and extending laterally therefrom to engage the free end portion of the bar 38 and move it toward the switch 32 for moving the control pin 36** inwardly of the switch for circuit changing action.

The housing sections 30*a* and 30*b* are secured together in a permanent water-tight manner in a conventional manner as by the use of a known adhesive to obtain the good permanent housing sealing the switch 32 within the housing.

By provision of the weight adjacent the free end of the activator arm 40, it will function effectively to swing through a control arc to move or set the switch 32 from a switch closing to a switch opening action dependent upon the relationship of the switch assembly 20 to a horizontal line. Hence, as such control switch assembly or means 20 reaches an angle of about 30° between the section 19 and the horizontal, the activator arm is then positioned to be moved to its switch closing position and the switch will retain such position until the water level is lowered to the off line. At that position, the gravity action on the activator arm is such as to open the switch when the section 19 forms an angle of approximately 45° with a horizontal line at the control switch means 20.

The activator arm is of sufficient weight and it has free pivotal mobility within the housing 30 so that such arm can move from circuit opening to closing position or vice versa even though the switch means 20 that forms a planar article is not itself positioned solely for movement in a vertical plane. If such switch means is laid over on its side to an angle of 20° to 30°, still the switch will function effectively for the desired control action in the sump and provide automatic control for the water level therein. The clamped resilient lead 19 extending into the housing 30 in sealed relationship thereto positions the control switch assembly 20 for movement that is substantially limited to being in a vertical plane. Usually the lead 19 is clamped just a few inches, such as 3 to 6 inches from the housing 30. Such lead 19 positions the relatively thin housing 30 in a vertical plane and the lead and its connection to the housing maintain the housing for movement substantially limited to such plane as it floats on the water in the sump.

The finger 48 may seat on the shoulder 50 in switch closing position.

By the present invention, a relatively inexpensive, positive acting control switch is provided for a sump pump so that the water level in the sump will be controlled automatically to be within safe limits. Thus, it is believed that a permanently functioning, low maintenance type of a switch control has been provided that will give a long service life. Hence, the objects of the invention have been achieved.

While one complete embodiment of the invention has been disclosed herein, it will be appreciated that modification of this particular embodiment of the invention may be resorted to without departing from the scope of the invention.

What is claimed is:

1. A float switch means for control of a sump pump or the like and comprising a housing, and a switch in the housing and having a control member extending from the switch to turn the switch on and off with movement of the control member, a lead connecting to the switch and extending from the housing in sealed relation thereto, and an activator arm having a free end and an end pivotally positioned in said housing for gravity actuated pivotal movement towards and from said switch to operatively engage and move said control member in one direction when engaged by said activator arm to change connections in said switch whereby said lead can be secured in position adjacent said housing and said float switch means can control a sump pump dependent on the water level in a sump and the angular position of said float switch means in relation to a horizontal axis.

2. A float switch as in claim 1 where a metal weight is carried by said actuator arm adjacent its free end.

3. A float switch as in claim 1 where said actuator arm has an offset lug extending therefrom and said housing has a shoulder thereon to engage said lug and limit movement of said arm towards said switch.

4. A float switch as in claim 1 where said switch has a pivotal control bar thereon to engage and move said control member and said actuator arm has a pin extending laterally therefrom to engage said control bar on movement of said actuator arm towards said switch and move said control member.

5. A float switch means as in claim 1 where means in said housing limit movement of said activator arm towards said switch.

* * * * *